United States Patent [19]

Masuda

[11] Patent Number: 4,527,788

[45] Date of Patent: Jul. 9, 1985

[54] PRINTER-SLOTTER WITH SPEED VARIABLE MOTOR CONTROL

[75] Inventor: Itsuro Masuda, Higashiosaka, Japan

[73] Assignee: Hamada Printing Press Mfg. Co., Ltd., Osaka, Japan

[21] Appl. No.: 636,661

[22] Filed: Aug. 1, 1984

[30] Foreign Application Priority Data

May 26, 1984 [JP] Japan ..... 59-107253

[51] Int. Cl.[3] ..... B41F 13/56

[52] U.S. Cl. ..... 270/21.1; 493/324; 101/248

[58] Field of Search ..... 270/21.1, 20.1; 493/34, 493/321, 324, 359, 360, 370, 241; 226/42; 101/183, 248

[56] References Cited

U.S. PATENT DOCUMENTS

| | | | |
|---|---|---|---|
| 1,763,679 | 6/1930 | Sticuney | 270/21.1 |
| 3,783,753 | 1/1974 | Rejsa | 493/34 |
| 3,817,067 | 6/1974 | Voorehes et al. | 226/42 |
| 4,057,185 | 11/1977 | Slama et al. | 226/42 X |
| 4,458,893 | 7/1984 | Ruh | 101/248 |
| 4,471,693 | 9/1984 | Tsukasaki | 493/324 |

*Primary Examiner*—E. H. Eickholt

*Attorney, Agent, or Firm*—Wenderoth, Lind & Ponack

[57] ABSTRACT

A printer-slotter having a blank feed unit, at leas tone printing unit and a creaser/slotter unit for printing, creasing and slotting the blanks fed one after another, the units each having a rotating member and arranged along the flow of the blanks and so as to be separable from each other, the printer-slotter comprising:

a reference signal operator for generating a reference signal and giving it to each of said units, each of said units comprising:

a speed variable motor for driving said rotating member;

a zero point sensor for detecting a zero point marked on said rotating member;

initial phase setting device for setting the initial phase of said rotating member of each unit on the basis of data obtained beforehand and in response to the signal from said zero point sensor;

a speed detector for detecting the speed of said variable motor and generating a speed signal proportional to its speed;

a phase detector for detecting the phase of said rotating member an generating a phase signal proportional to its phase; and a control circuit for controlling the speed of said speed variable motor so that said speed signal and said phase signal will be equal to the signal from said reference signal generator.

1 Claim, 2 Drawing Figures

PRINTER-SLOTTER WITH SPEED VARIABLE MOTOR CONTROL

Figure 1:
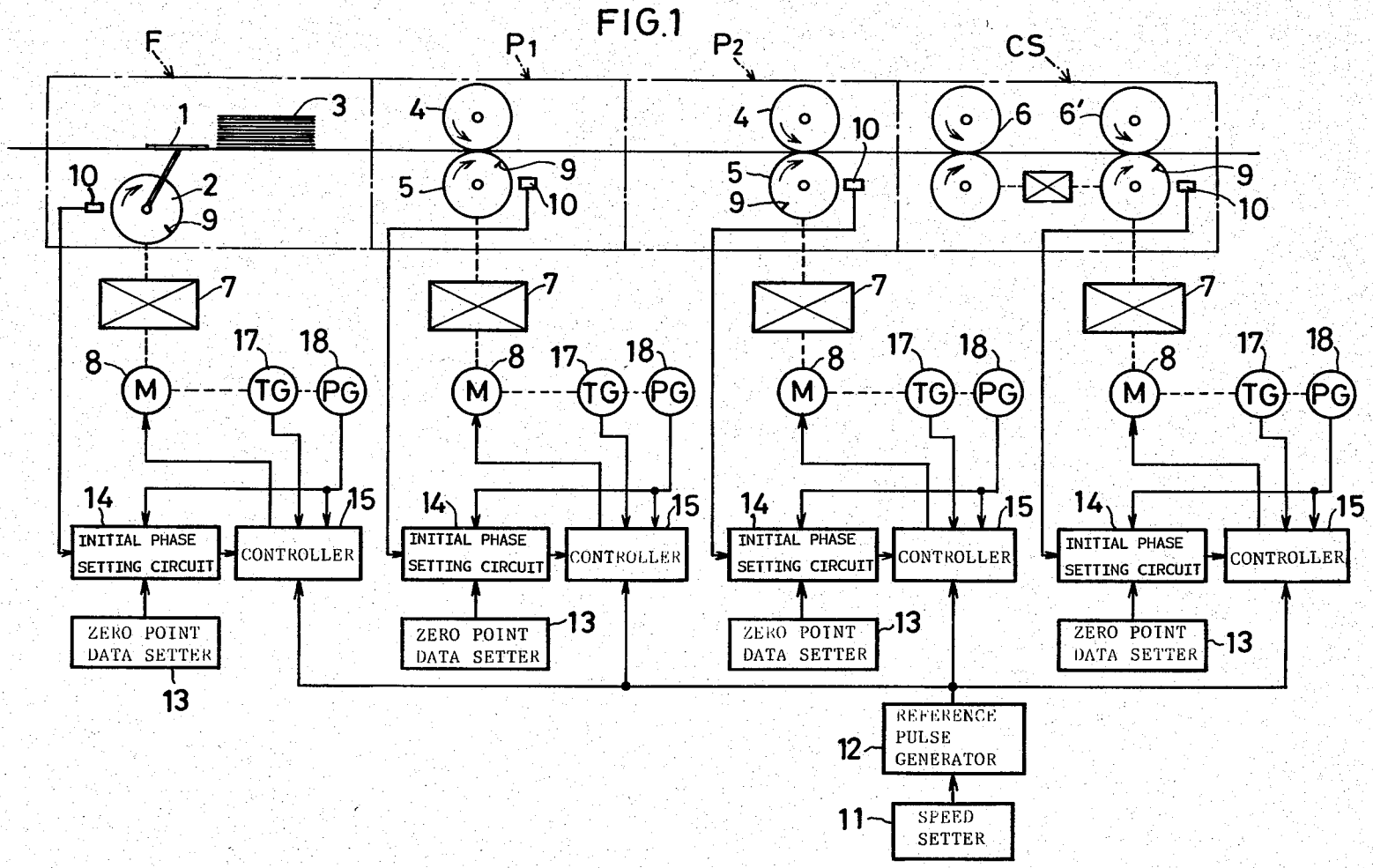

The present invention relates to a printer-slotter used to continuously print, crease and slot blanks of corrugated cardboards or the like cut to a predetermined size and fed from a stack of them.

A printer-slotter has one or more printing units as many as the number of printing colors, and a blank feed unit for feeding the blanks to the printing units, and a creaser/slotter unit for creasing and slotting the blanks from the printing units. These units are coupled and interlocked with each other through belt and/or gear transmission so as to be driven from a single main motor having a variable speed and a large capacity. These units are adapted to be separable from each other in a longitudinal direction for the replacement and maintenance of the plate cylinders.

On such a conventional printer-slotter, in order to re-couple the units together into an operable state after separating them from each other for maintenance, the gears have to be properly re-engaged with each other so that the phase difference between the units will be the same as before disassembling. This requires a very troublesome work.

Also, the plate cylinders in the printing units and the slotter shaft in the creaser-slotter unit are provided with a running register as a registering means for correcting any deviation of the position of the blank relative to the circumferencial position of the plate cylinder and the slotter. This running register driven manually or by a small motor are built in the driving gear train for the plate cylinder and slotter shaft. This further complicates the structure and makes the machine difficult to reassemble and maintain. This offers a hindrance for more compactness of the entire machine.

On such a conventional printer-slotter, repeated test printings and phase settings were essential for exact registering at all the units before starting the operation. This is very wasteful of time and material and decreases the work efficiency and yield.

An object of the present invention is to provide a printer-slotter which is easy to prepare for the start of operation.

Another object of the present invention is to provide a printer-slotter which has a high operation efficiency and is simple in mechanical construction.

In order to feed the blanks of corrugated cardboard one after another, print them at a predetermined position and crease and slot them at predetermined positions, the rotating members of the blank feed unit, printing units and creaser/slotter unit have to be put in a relative phase relationship predetermined according to the data obtained beforehand for each production lot. Such a phase relationship between the units has to be kept unchanged during operation.

In accordance with the present invention, for the initial phase setting prior to the start of printing, data as to how far the initial phase for the rotating member of each unit should be from the position of the zero point sensor is given to the initial phase setter, which rotates the rotating member of each unit until its zero point comes to the preset initial phase.

After this initial phase setting, a common reference signal is supplied to the controllers for all the units so that the speed and phase of the rotating members of all the units will be controlled according to the reference signal. Thus, the phase relationship between the units preset at the initial phase setting is maintained unchanged throughout the operation.

Figure 2:
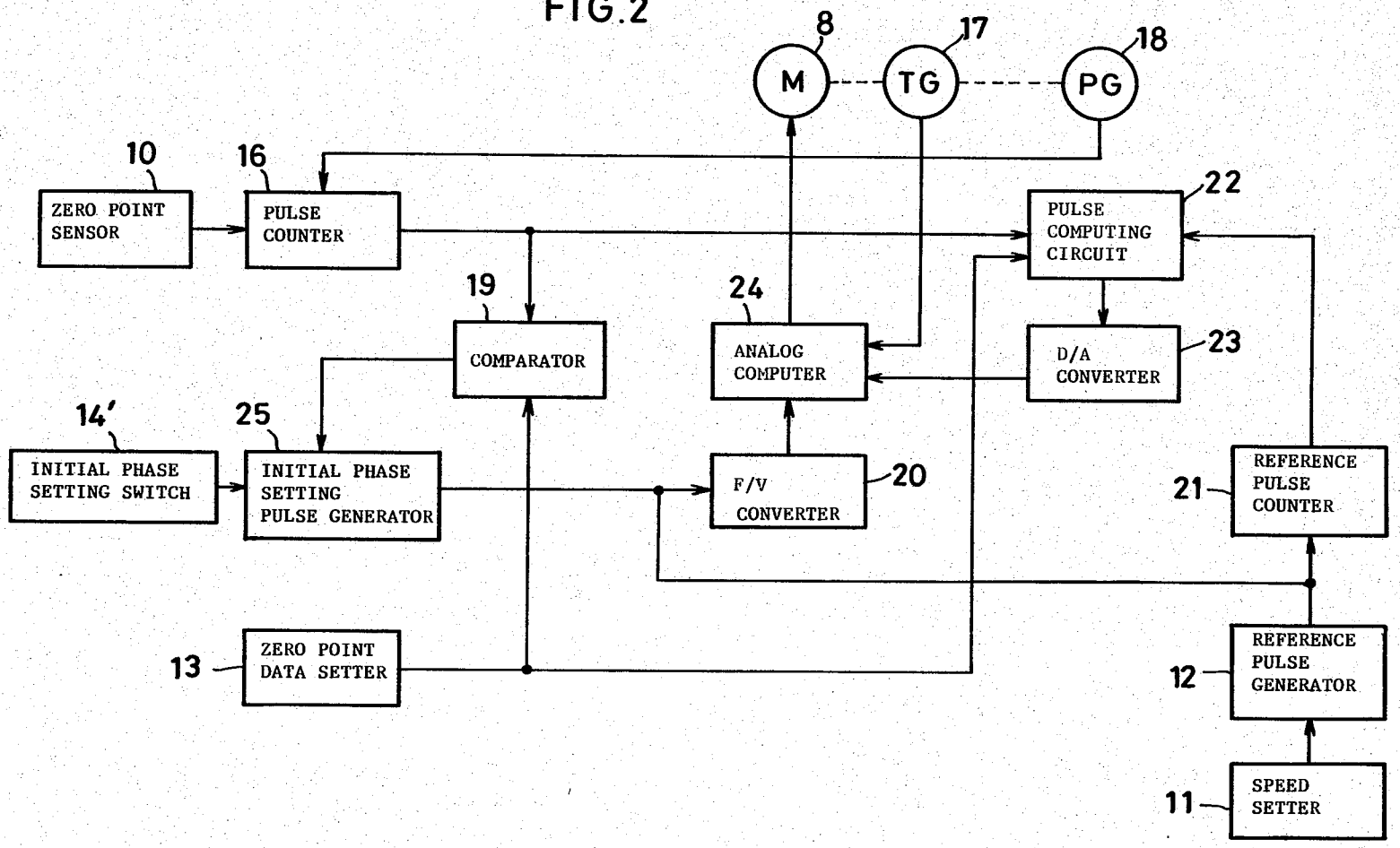

Other objects and features of the present invention will become apparent from the following description taken with reference to the accompanying drawings, in which:

FIG. 1 is a block diagram of printer-slotter embodying the present invention; and FIG. 2 is a block diagram of an example of a control system used therein.

Referring to FIG. 1, a printer-slotter embodying the present invention comprises a paper feed unit F, a first printing unit $P_1$, a second printing unit $P_2$ and a creaser/slotter unit CS.

The paper feed unit F has a kicker feeder 1 driven by a rotary member 2 to feed the lowermost blank one after another from a stack of corrugated cardboards 3 to the first printing unit $P_1$. When passing between a plate cylinder 4 and an impression cylinder 5 driven synchronously in the first and second printing units $P_1$ and $P_2$, each blank is printed by means of a printing plate detachably mounted on the plate cylinder 4, with the first and second colors, respectively. At the creaser/slotter unit CS, each blank is creased by a pair of creaser rolls 6 and slotted by a pair of slotter rolls 6'.

The creaser rolls 6 and the slotter rolls 6' are driven interlocked with each other. The rotary member 2, plate cylinders 4 and impression cylinders 5, and slotter rolls 6' are driven independently from a DC servomotor 8 through a speed reducer 7.

The rotary member 2, plate cylinder 4 or impression cylinder 5, and slotter roll 6' are each provided with a sensor 10 for detecting a zero point mark 9 put on the outer periphery of their end. The control system for each DC servomotor 8 comprises a reference pulse generator 12 which generates for all the units pulses of a frequency proportional to the speed set on a speed setter 11, an initial phase setting circuit 14 for setting the initial phase for each rotating member (2, 5 and 6') on basis of the data set on a zero point data setter 13, and a controller 15.

Each DC servomotor 8 is provided with a tachometer generator 17 which generates a DC voltage proportional to the speed of the servomotor and a pulse generator 18 which generates pulses at a rate of 3,000 pulses per revolution of the servomotor. In the preferred embodiment, the ratio of speed reduction by the speed reducer 7 is 5:1. Thus, the pulse generator 18 generates 15,000 pulses per revolution of the rotating member (2, 5 and 6').

The initial phase setting circuit 14 and the controller 15 may be of such a structure as shown in FIG. 2.

The initial phase setting circuit 14 may comprise a phase pulse counter 16 which is reset as soon as the sensor 10 detects the zero point mark 9 and starts counting the pulses from the pulse generator 18 which represent the phase of the DC servomotor 8 and thus that of the corresponding rotating member, an initial phase setting pulse generator 25 which is started by an initial phase setting switch 14' to generate the pulses for setting the initial phase of the servomotor 8, and a comparator 19 which compares the content of the phase pulse counter 16 with the content of the zero point data setter 13 and gives an output for stopping the initial phase setting pulse generator 25 when they become equal to each other.

The controller 15 may comprise a frequency-voltage converter 20 which converts the reference pulses of a predetermined frequency supplied from the reference pulse generator 12 to a reference voltage, a reference pulse counter 21 which counts the reference pulses, a pulse computing circuit 22 which computes the content of the reference pulse counter 21 plus the content of the zero point data setter 13 minus the content of the phase pulse counter 16, a digital-analog converter 23 which converts the output of the pulse computing circuit 22 to a DC voltage proportional to it, and an analog regulator 24 which receives the output of the F/V converter 20 as the reference input and receives the output of the D/A converter 23 and the output of the tachometer generator 17 as feedback inputs, thus controlling a power supply (not shown) for each DC servomotor 8.

The tachometer generator 17 is adapted to feed back to the analog regulator 24 a voltage equal to the reference voltage while the servomotor 8 is rotating at a predetermined reference speed, and a voltage proportional to the actual motor speed while it is rotating at a speed other than the reference speed. The analog regulator 24 functions to keep the speed of the servomotor 8 at the reference speed. The data about the zero point for each rotating member obtained beforehand is given to the zero point data setter 13 and converted to the pulses of a number equal to the initial phase, and memorized.

It will be described how to do the initial phase setting. First, the zero point data (showing how far the initial phase should be from the zero point sensor 10) for the rotating member of each unit is set on the zero point data setter 13. The initial phase setting switch 14' is turned on to actuate the initial phase setting pulse generator 25. The pulses from the pulse generator 25 are converted by the F/V converter 20 to a DC voltage which activates the DC servomotor 8. As it rotates, the pulse generator 18 generates the pulses.

At the instant the mark 9 on each rotating member is detected by the mark sensor 10, the pulse counter 16 is reset and starts counting the pulses from the pulse generator 18. The count of the pulse counter 16 is compared in the comparator 19 with the pulse signal stored in the zero point data setter 13. When they become equal to each other, the comparator 19 gives to the initial phase setting pulse generator 25 a signal for stopping its operation. Thus, the rotating members driven by the DC servomotors 8 will stop at the respective initial phases memorized in the zero point data setter 13. In the preferred embodiment, since the pulse generator 18 generates 15,000 pulses per revolution of each rotating member, the initial phase can be set at an accuracy of 1/15,000 of the circumferencial length of each rotating member.

After the initial phase has been set in the above-mentioned manner for all the units, a required reference speed is set on the speed setter 11. The voltage proportional to the reference speed will be supplied to the reference pulse generator 12, which supplies to the controllers 15 for all the units the reference pulses of a fixed frequency proportional to the reference speed.

For each unit, the reference pulses are converted by the F/V converter 20 to a reference voltage, which is applied to the DC servomotor 8 through the analog regulator 24. As a result, the DC servomotors for all the units will run at the reference speed. If the motor speed deviates from the reference speed, the tachometer generator 17 will feed a voltage proportional to the speed back to the analog regulator 24, as mentioned above, so that the servomotor 8 will be controlled to maintain the reference speed.

On the other hand, the pulses from the pulse generator 18, the number of which represents the phase of each rotating member, are counted by the pulse counter 16. Its count represents the initial phase plus the amount by which the phase has actually changed. Its count is compared in the pulse computing circuit 22 with the number of pulses memorized in the zero point data setter 13 plus the count of the reference pulse counter 21 (which represents the initial phase to be given for each rotating member plus the amount of change in phase to be given by the reference pulses). If there is any difference between them, it is converted by the D/A converter 23 to a voltage, which is fed back to the analog regulator 24. The voltage causes the servomotor 8 to accelerate or decelerate by its amount. This will result that each rotating member is controlled so that the actual change in phase after the initial phase setting will be equal to the required change in phase given by the reference pulses. In the abovementioned manner, the difference in phase between the units is kept constant at the difference in phase just after the initial phase setting.

What is claimed is:

1. A printer-slotter having a blank feed unit, at least one printing unit and a creaser/slotter unit for printing, creasing and slotting the blanks fed one after another, said units each having a rotating member and arranged along the flow of the blanks and so as to be separable from each other, said printer-slotter comprising:

reference signal generating means for generating a reference signal and giving it to each of said units, each of said units comprising:

a speed variable motor for driving said rotating member;

a zero point sensor for detecting a zero point marked on said rotating member;

initial phase setting means for setting the initial phase of said rotating member of each unit on the basis of data obtained beforehand and in response to the signal from said zero point sensor;

speed detecting means for detecting the speed of said speed variable motor and generating a speed signal proportional to its speed;

phase detecting means for detecting the phase of said rotating member and generating a phase signal proportional to its phase; and control means for controlling the speed of said speed variable motor so that said speed signal and said phase signal will be equal to the signal from said reference signal generating means.

* * * * *